US005967470A

United States Patent [19]

Guschlbauer

[11] Patent Number: 5,967,470

[45] Date of Patent: Oct. 19, 1999

[54] DOLL STAND

[76] Inventor: Franz Guschlbauer, Johann-Strauss Gasse 52, Moedling, Austria, 2340

[21] Appl. No.: 08/921,816

[22] Filed: Sep. 2, 1997

Related U.S. Application Data

[63] Continuation of application No. PCT/AT95/00158, Jul. 28, 1995.

[30] Foreign Application Priority Data

Jul. 29, 1994 [AT] Austria ..... 1503/94

[51] Int. Cl.[6] ..... A63H 3/00

[52] U.S. Cl. ..... 248/121; 248/176.1; 446/268

[58] Field of Search ..... 248/176.1, 121, 248/125.8, 125.9; 223/66; 446/268; 297/195.11

[56] References Cited

U.S. PATENT DOCUMENTS

| | | | |
|---|---|---|---|
| 225,587 | 3/1880 | Garrigus | 403/93 X |
| 352,161 | 11/1886 | Staples . | |
| 425,709 | 4/1890 | Schilling . | |
| 479,481 | 7/1892 | Willcox . | |
| 782,364 | 2/1905 | Soule | 297/195.11 |
| 995,982 | 6/1911 | Moore et al. . | |
| 1,268,245 | 6/1918 | Hoiland | 248/349.1 X |
| 1,627,652 | 5/1927 | Kornicker et al. . | |
| 2,527,152 | 10/1950 | Ransom et al. . | |
| 2,919,877 | 1/1960 | Gallagher . | |
| 3,009,284 | 11/1961 | Ryan | 446/268 X |
| 3,512,741 | 5/1970 | Goldstein | 223/66 X |
| 3,516,632 | 6/1970 | Hall . | |
| 4,706,915 | 11/1987 | Cindric et al. . | |
| 5,549,499 | 8/1996 | Foskey et al. . | |
| 5,551,656 | 9/1996 | DeLozada et al. | 248/176.1 |

FOREIGN PATENT DOCUMENTS

| | | |
|---|---|---|
| 1346860 | 11/1963 | France . |
| 9205195 | 7/1992 | Germany . |
| 9205187 | 8/1992 | Germany . |

*Primary Examiner*—Derek J. Berger
*Attorney, Agent, or Firm*—Herbert L. Lerner; Laurence A. Greenberg; Werner H. Stemer

[57] ABSTRACT

The doll stand has a base, a vertical support part between the legs of the doll when in use, a carrying part and holding parts. A coupling part connects the carrying part to the vertical support part. The carrying part is a single manufacture with a coupling part extending downwards from its middle section and holding parts which project upwardly from its end. The carrying part is bandaged onto the doll, and the doll and carrying part are placed on the vertical support part. The lower end of the support part is either attached to a visible base plate or, in an embodiment without the base plate, in or below a presentation plate. The legs can be moved and the doll can be rotated either mechanically or by hand. The holding parts may include tension straps, brackets, and it may be formed as a seat bowl.

22 Claims, 5 Drawing Sheets

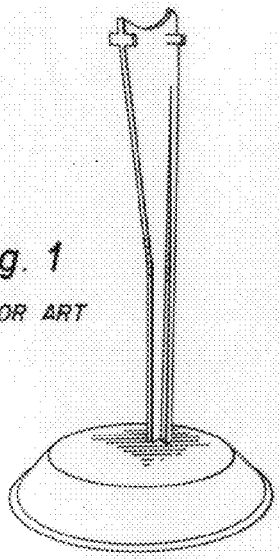
Fig. 1
PRIOR ART
Fig. 2
PRIOR ART
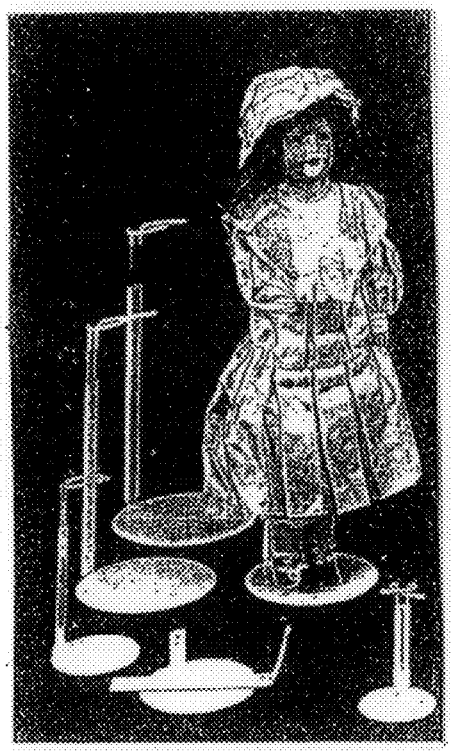

DOLL STAND

CROSS-REFERENCE TO RELATED APPLICATION

This application is a continuation of my copending international application PCT/AT95/00158, filed Jul. 28, 1995, which designated the United States.

BACKGROUND OF THE INVENTION

1. Field of the Invention

The invention relates to doll stands, i.e., to stands for supporting and holding dolls. When in use the stand has a support part which is positioned between the legs of the doll and which extends vertically to the lower body of the doll. The support part is attached to an element which keeps it in the vertical position.

Dolls produced before and shortly after 1900 are referred to as antique dolls and are today valuable, and in some cases extremely valuable, collectors items. Such collections form the basis of many doll museums. In museums the visitor sees the dolls displayed alongside each other. They are held on the rear side by the doll stands and the viewer can see their faces and the fronts while the legs are held identically and monotonously on the base plate of the stand.

Fashion dolls, for example, which in the 19th century were dressed exactly to scale in the latest fashion and sent abroad for advertising purposes were lovingly viewed from all angles. These and the equally wonderful girl and boy dolls cannot be displayed in profile or in their all-round beauty using the customary doll stands.

2. Description of the Related Art

U.S. Pat. No. 4,706,915 to Cindric et al. describes various groups of doll stands. The following specification expands on that grouping and provides a further, expanded overview of the field.

Group A: Doll stands that require the support part to be inserted into an opening or drilled hole in the doll made for this purpose. In U.S. Pat. No. 3,009,284, the holes are formed in the feet.

Group B: Doll stands that grip the feet or the legs of the doll at various levels to hold the doll upright. In order for such stands to function properly, it is necessary that the doll be able to stand on its own, i.e. the doll's joints (feet, knee, hips) may not bend under the weight of the standing figure.

Both feet are restrained in accordance with German utility model DE-GM 92 05 187.1 of April 1992. Both lower legs are retrained in accordance with French Patent No. 1,346,680 of February 1963 and U.S. Pat. No. 3,675,362 of December 1970. Both thighs are restrained in accordance with U.S. Pat. No. 3,516,632 of August 1968.

These stands require that the doll be able to stand upright on its own. The wire support part extends upwardly between the doll's legs and ends with two horizontally positioned loops at the doll's lower body. These loops wrap around the thighs of the doll and hold them. Both feet must rest on the base plate and support the weight of the doll.

Group C: These stands are characterized by a support part that extends upwardly either behind the rear of the doll or between the doll's legs to the doll's back. The support holds the torso of the doll with a wire clamp, preventing the doll from bending at the hip joints.

An early example of this type of stand is the English Patent No. 18,419, dating from 1889 and patented in the name of an inventor from Sonneberg, the center of the German doll making industry. The wire clamps of that disclosure are angled at the top, which is important as the dolls from that period had noticeably enlarged posteriors. The angle of the line that connects the posterior to the upper back of the doll can be estimated as approx. 10° from vertical. The inventor was obviously undisturbed by the fact that the support part was fully visible, as it did not fit under the clothing worn by the doll.

Shortly thereafter, U.S. Pat. No. 479,481 was granted in 1892. In that disclosure the angled nature of the support part can be clearly seen. This meant that the wire clamp could fit under clothing that was not too tight. For tight-fitting clothing, one must decide whether the bumps in the clothing are acceptable or if the support part should be attached from the outside. With minor variations, this doll stand from the year 1892 represents the type of doll stand construction most commonly used today.

The stand shown in FIG. 2, for example, offers the option of bending the mounting which is fixed to the base plate and onto which the support part is attached. Another variant has a rigid sectional through to the base plate. The support's fixed angle of approx. 6° from vertical is a compromise and is generally too small for antique dolls.

The weight of antique dolls is the next problem for this type of stand construction. Depending on the type of construction—such as very old dolls with paper mache heads and leather bodies or later dolls with articulated bodies and porcelain heads with wigs, elaborate costumes, accessories and jewelry—the weight of various kinds of dolls can be estimated as follows: doll height 40 cm—approx. 0.8 to 1.2 kg; 60 cm— approx. 1.7 to 2.3 kg; 80 cm—approx. 2.9 to 3.7 kg; 100 cm—approx. 4.5 to 5.5 kg.

When such a doll is mounted on this type of stand, certain points have to be considered for optimal positioning: the pressure of the wire clamps may not damage the doll's painted body or clothing; the doll's feet should rest on the base plate; the pressure of the wire clamp should strong enough to securely support the doll; the friction between the sectional tubing and the clamping wire must be great enough to ensure that the wire clamp does not slip. Usually a number of attempts are necessary before these factors can be adjusted properly to each other, which means the doll can be damaged and its value reduced.

German utility model DE-GM 92 05 195.2 of April 1992 may be described as follows: The object of that stand is to allow one leg to move freely, while the other leg supports the weight of the doll. A support part extends upwardly behind the load-bearing leg and holds the torso with a rubber strap. The doll must be able to stand on its own.

A quite interesting suggestion is found in U.S. Pat. No. 352,161, issued in 1886: there is shown a type of construction that has the support positioned between the legs of the doll. Two wire clamps extend upwardly from that support to the lower torso—one on the front side and one on the rear side—which can be adjusted in height. Dolls displayed using this stand are thus supported from the front and from the rear. The doll's legs provide the necessary lateral support. The doll must be able to stand on its own. From an aesthetic point of view, it is interesting that the supporting rod is more hidden from view.

Group D: This group consists of doll stands that have a support part extending vertically behind the posterior of the doll, which has a support arm that is positioned between the legs on the lower torso.

U.S. Pat. No. 2,527,152, issued in 1945, shows a strap extending upwardly on the rear side of the doll, with a 180° angle in the small of the back, which leads between the doll's legs and up the lower stomach of the doll to about the height of the hips. The straps on the back and stomach of the doll are held in place on the lower torso with a belt. For some dolls an alternative is used, in which the strap extends vertically along the stomach of the doll to the height of the hips. From the vertically positioned strap on the rear side of the doll to the strap that is slightly angled away from the body on the stomach of the doll, another strap which is attached to the rear strap extends between the legs. Both of the straps, reach approximately to the height of the hips, are held against the lower torso with a belt. For adjusting height, the straps—which can be considered to be the support—are divided into two parts and have drilled holes, so that the divided straps can be set in place by fixing them against each other. The fact that the height can only be adjusted in a step-by-step manner means that the doll cannot be fully and completely supported. For this reason and due to the low resistance of a single strap on the rear of the doll as a support, this aesthetically less than pleasing construction requires use of the doll's legs for support.

U.S. Pat. No. 4,706,915 (issued in 1986) allows the height of the doll stand to be adjusted in two places (on the bracket between the legs and on the supporting element on the upper torso). The bracket must be flexible in order to be able to adapt the front part of the bracket to the doll. This flexibility, however, makes the bracket less well suited for supporting larger dolls. Consequently, the bracket cannot be considered as a supporting element and the legs of the doll must bear the weight of the doll.

Group E: This group consists of doll stands that support the doll on a vertical support part extending upwardly between the doll's legs.

With reference to FIG. 1, there is shown a doll stand of the company Mattel Inc. (Malaysia, 1985 3415-Q 503-6-1) for the BARBIE® doll. The stand includes a flat support part attached to a base plate, which extends vertically between the doll's legs and has a saddle-shaped depression at the top. The lower body of the doll can be placed in this saddle-shaped depression, which supports the doll between the legs from below. In order to prevent the doll from falling forwards or backwards (the doll's legs are supported laterally by the stand), the support has a pair of protrusions on both sides underneath the depression. These hold the thighs of the doll and prevent it from falling forwards or backwards.

This requires, however, that the hip joints be sufficiently stiff, as otherwise the doll's body can fall over, even though the legs are held firmly by the stand. The hip joints must also be stiff laterally, as the protrusions act as a wedge between the legs.

In summarizing the prior art, the term doll show triggers associations such as antique dolls or reproductions thereof. Further, "artistic" dolls have lately become very popular. Those dolls share the characteristic that they are heavy and almost always have rubber cords for making the joints moveable. Generally, those dolls cannot securely stand on their own, especially if the doll in question is old. These factors make Group A and B unsuitable for use with such dolls. Group C and D have the support parts positioned on the edge of the base plate (with the exception of U.S. Pat. No. 352,161), which is unsightly for the viewer.

Additional disadvantages associated with the prior art doll stands may be categorized as follows: Clumsy handling when removing the doll from the stand and positioning the doll on the stand, combined with the adjustments required to make the proper fit, increase the danger that the doll or doll's clothing will be damaged; the doll's clothes are subject to deformation by the stands; the stiff, backward leaning position of the doll resulting from the construction of the stand does not portray natural body posture; effects of the bending and tilting moments arising from the construction of the stand are difficult to estimate; even small dolls cannot be rotated without turning the base plate as well; free movement of the legs is limited.

Groups C and D are limited in application, if, due to weight considerations, the doll's feet must stand on the base plate. Leather bodies with sewn knee and hip joints cannot bear loads. None of the doll stands described could support a leather body "Paulinen" doll, with a height of 78 cm and a weight of 4.6 kg, made around 1840, in a standing position. The joints of dolls with articulated limbs slowly change position and slip. At some point or another, the doll finally comes to rest. Group E stands, such as that of Mattel Inc. as described above, support the doll near the center of gravity and, depending on the size of the stand, can support dolls of all sizes. As was mentioned though, the doll must have sufficiently stiff hip joints. This condition is not met for antique dolls, reproductions and artistic dolls. Hence this type of stand cannot be employed for these types of dolls. This leaves the interesting task of inventing a doll stand, which, based on a support part between the legs, can safely support dolls of any size while simultaneously ensuring optimum display and presentation.

SUMMARY OF THE INVENTION

It is accordingly an object of the invention to provide a doll stand, which overcomes the above-mentioned disadvantages of the heretofore-known devices and methods of this general type and which substantially improves the familiar doll stands with a support part extending upwardly between the legs of the doll to the bottom of the torso in such a way that the resulting doll stand can securely support and hold antique dolls, artistic dolls, reproductions of antique dolls and any other dolls which are to be displayed in a standing position.

The doll stand described below in three embodiments has a level of functionality that meets all the requirements for the optimum presentation of valuable dolls.

With the foregoing and other objects in view there is provided, in accordance with the invention, a doll stand for supporting and holding a doll in an upright position, wherein the doll has a torso with a lower body and legs attached to the torso, the doll stand comprising:

a base;

a vertical support part mounted on the base and held in substantially vertical orientation, the support part extending vertically between the legs of the doll to the lower body of the doll;

a carrying part for supporting a weight of the doll on the vertical support part, the carrying part including a middle section connected to the vertical support part and positioned between the legs of the doll, a front side holding part attached to and projecting upwardly from the middle section for holding a stomach side of the doll, and a rear side holding part attached to and projecting upwardly from the middle section for holding a posterior side of the doll.

In accordance with an added feature of the invention, the vertical support part is attached to the middle section substantially centrally thereof.

In accordance with an additional feature of the invention, the middle section is integrally formed with the vertical support part.

In accordance with an another feature of the invention, there is provided a coupling part attached to and projecting downwardly from the middle section for attachment to the vertical support part.

In accordance with a further feature of the invention, the coupling part and the vertical support part together form one of a plug and socket connection, a screw connection, and a clamp connection.

In accordance with again an added feature of the invention, the vertical support part is formed from elongated components selected from the group consisting of rods sections and tube sections.

In accordance with again a further feature of the invention, the vertical support part has a top end for connection with the middle section of the carrying part.

The particular advantages of this doll stand are:

The support part, preferably made of steel, has a small diameter which remains the same from top to bottom and is partially or completely concealed by the legs and clothing. The support part also has an elegant appearance if it should be seen between the legs of male dolls with trousers.

The carrying elements (carrying part with the middle section 3, holding parts 5 and 6, coupling part 4) are best fitted to the lower body of the doll before the doll is mounted on the upper end of the support part with these carrying elements. The best connection between the support part and carrying elements is a plug and socket combination. It is easy to mount and remove the doll and the doll is safety supported. The legs of the doll are not required for support.

The legs of the doll are free and can be positioned gracefully.

The plug and socket connection is also a pivot which means that, as the doll is not attached to the ground, it can be turned around its own axis. The increase to the circumference of the doll caused by the holding parts 5 and 6 and bandage 9 is so small that even tight fitting clothing falls perfectly naturally; this doll stand is also ideal for use by makers of dolls' clothes restoring or making dolls' clothes. The clothes maker can turn the doll and work comfortably. The posture of an attractive doll can be proudly erect or inclined in friendliness; this effect is achieved by slightly bending the insert element.

The fixing device on the lower end of the support part works well if it is welded to the underside of the base part and is visible as an even rod or tube on the upper side of the base plate.

A turntable which stands on the presentation plate (e.g. the bottom of a display case) and which allows the base part, support part and mounted doll to be turned also works well. However, the lower end of the support part can also be connected directly with the drive shaft of the turntable on the presentation base instead of with the base plate. The visible part of the turntable stands still and the dolls turns as if it were an automaton.

The most aesthetic effect is achieved if the support part is extended through the presentation plate and is connected to a rotating mechanism located on the underside of the presentation plate.

If no rotating mechanism is desired, the support part can be attached directly into the presentation plate.

Extending the support part through the presentation plate and supporting it with a holding device on the underside of the presentation plate has the advantage that a support part consisting of a single element with greater scope can be set at the correct height.

If the support part is attached into the presentation plate or its underside, the base plate is unnecessary.

Other features which are considered as characteristic for the invention are set forth in the appended claims.

Although the invention is illustrated and described herein as embodied in a doll stand, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWING

FIG. 1 is a perspective view of a prior art doll stand;

FIG. 2 are various perspective views of prior art doll stands;

DESCRIPTION OF THE PREFERRED EMBODIMENTS

Figure 3:
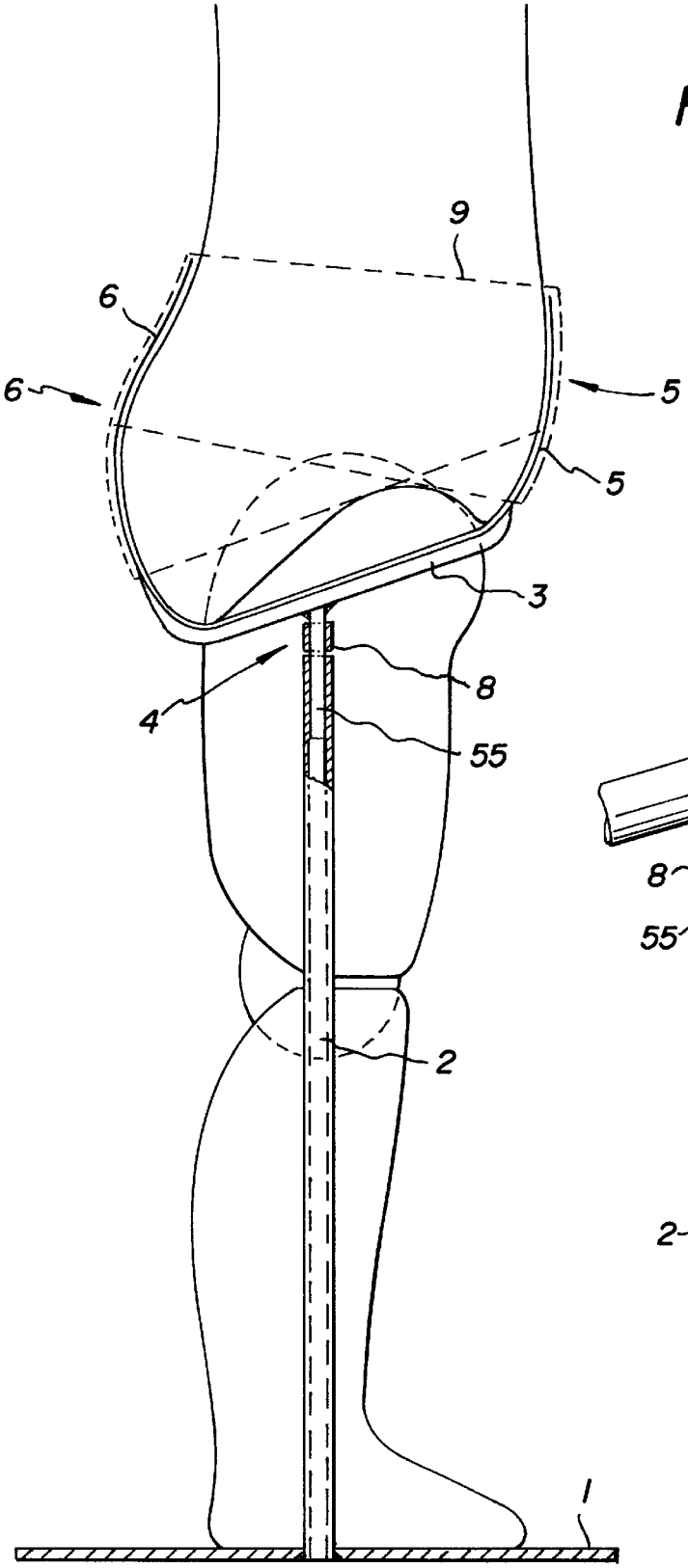
FIG. 3 is a side elevation of a first embodiment of the doll stand according to the invention.
Figure 4:
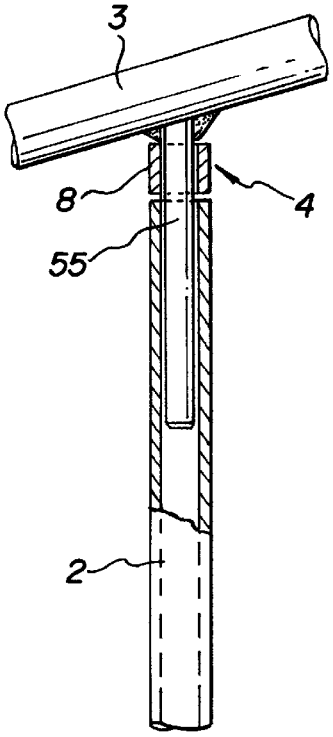
FIG. 4 is a partial side elevation of a coupling part with a plug and socket connection, showing the part of FIG. 3 on an enlarged scale.

Referring now to the figures of the drawing in detail and first, particularly, to a first embodiment illustrated in FIG. 3 thereof, there is seen a doll stand with a base part made of metal, wood, plastic, or the like. The base part is in the form of a plate 1, such as a decorative plate 1. The vertical support part 2 (in this case a tube) is permanently or detachably mounted substantially in the center of the base part 1. The support part 2 includes a tube or a rod or a combination of the two, such as a locking telescope assembly.

The plate 1 is a display plate formed of display wood or decorative plastic. The thickness and rigidity of the plate are adjusted to the intended size of the doll to be supported. By way of example, a wooden plate may have a thickness of approximately 30 mm. The plate may also be a two-layer plate with the uppermost plate carrying the support part 2 and rotating therewith. In the alternative, the support may also be attached on a display base, or in the floor of a display box.

A coupling part in the form of a pin extends down vertically and is attached to the middle part of the carrying part 3 (e.g. a wire bracket) which is adjusted to fit the form of the doll's lower body between the legs and the stomach and into the cleft of the buttocks. Attached to both ends of the carrying part 3 are the tension straps 5 and 6 which extend upwards to the stomach and the back of the doll (for 40 cm dolls: 0.8 mm thick Cu or MS sheet metal. The tension straps 5 and 6 counter the forces resulting from the doll's weight and forces acting on the doll and transfer these forces to the carrying part 3. If tension straps made of metal are used, adhesive tape is applied to the side of the tension straps that touch the body of the doll (with the non-adhesive side of the tape facing the body of the doll). Depending on the size of the doll, this adhesive tape overlaps the lengthwise edges of the tension straps 5 and 6 by various amounts.

The carrying part 3 prepared with coupling part 4 and tension straps 5 and 6 is put onto the doll and coupling part placed upon the support part 2. The position and posture of the doll are adjusted and tension straps 5 and 6 provisionally bandaged. The doll and carrying part 3 are lifted off and bandage 9 completed. The doll and carrying part are placed on support part 2 once more. Taking into account the position of the legs and the clearance to the floor the correct length of the support part is determined and then adjusted. Any adjustments to the height of the support part are made with the spacing sleeve 8. Polyethylene plastic shrink wrap foil is well suited as a material for the bandage. Due to the shrinkage effect this material adheres to the body of the doll without glue and leaves no residue when it is removed. The tension straps 5,6 adhere to the adhesive tape and bandage 9 adheres to the adhesive tape and the body of the doll. Layer is stuck against layer. A few layers of unshrunk 30 $\mu$m thick foil are sufficient to ensure that the tension straps 5 and 6 are firmly fixed to the body of the doll. If tension straps 5 and 6 are made of plastic and if the surfaces of the tension straps 5,6 which face bandage 9 are rough enough to ensure that bandage 9 does not slip, the adhesive bands are unnecessary.

If the carrying part 3 that extends between the legs of the doll fails to adequately fill the space between the legs, a spacer can be used, preferably in the form of rubber blocks mounted onto the carrying part 3 to prevent the carrying part 3 from slipping. To adjust the posture of small and medium-sized dolls, the angle of pin 55 to carrying part 3 can be altered by bending pin 55.

Figure 5:
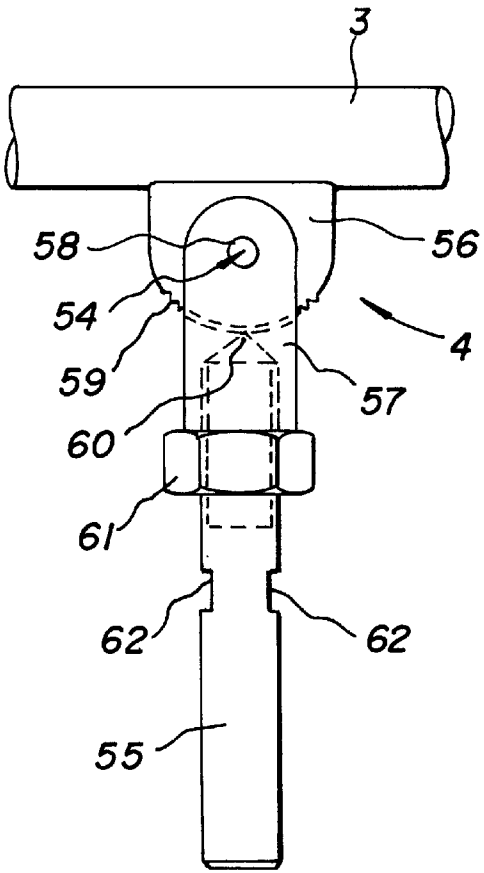
FIG. 5 is a similar view of a further embodiment of the coupling part, particularly for large dolls.

With reference to FIG. 5, there is shown a different embodiment of coupling part 4 for large and very large dolls where it is not advisable to bend pin 55. In this embodiment, pin 55 which is inserted into support part 2 is connected by a hinge 54 to carrying part 3. A secure interlocking or gravity actuated hinge 54 adjusts the angle between carrying part 3 and pin 55 so that the doll stands with the desired posture. Hinge 54 consists of a disk 56 attached to carrying part 3 and a fork-shaped carrier 57 that is connected to the pin 55. The disk 56 fits into the fork-shaped carrier 57 and these two pieces are connected with each other with a hinge bolt 58.

In order to set the angle between carrying part 3 and pin 55 there are indentations 59 on the edge of the disk, into which a tip 60 of pin 55 engages when the latter is screwed into carrier 57. To make it easier to screw pin 55 into carrier 57 or to ensure that the connection between 55 and disk 56 is stable enough, pin 55 has two other indentations opposite one another upon which a fork spanner can be placed.

In order to prevent pin 55 from being unscrewed out of carrier 57, a counter nut 61 is provided which allows the pin 55 to be tightened against the carrier. This hinge makes the removal and refitting of bandage 9 unnecessary. The doll is lifted off support part 2 and put back into position again while still attached to carrying part 3.

For dolls up to approx. 40 cm where the distance between the legs on the lower body is large enough to allow tension straps 5 and 6 to be extended with even width between the legs of the doll, a carrying part 3 becomes unnecessary and coupling part 4 is placed on the tension straps 5,6 in the area between the doll's legs.

Figure 6:
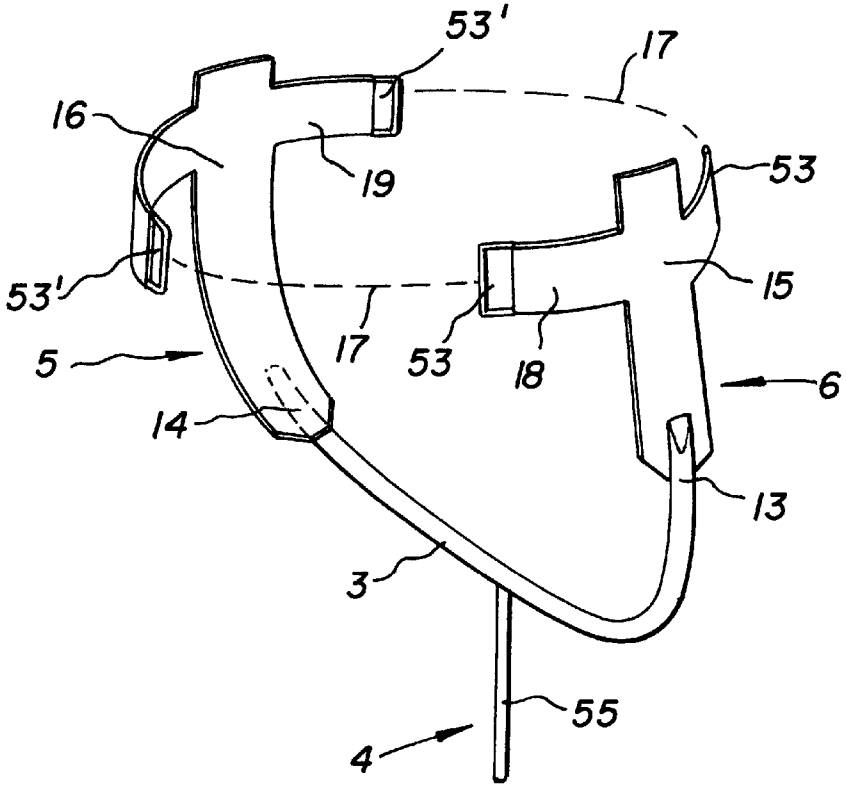
FIG. 6 is a partial perspective view of a further embodiment of the stand with bracket shaped holding parts 5, 6 on one carrying part.

FIG. 6 shows a further embodiment of holding part 5, 6 on carrying part 3 with coupling part 4 shown in the form of pin 55. Cross-shaped holding plates 15,16 (preferably made of plastic) are attached to a rear bracket 13 and a front bracket 14 which are formed as a single piece with carrying part 3. The crosswise struts 18,19 of the holding plates 15,16 extend horizontally and partially encompass the lower body of the doll giving a firm hold on the doll's body.

The brackets 13,14 with carrying part 3 can be elastic so that the holding plates 15,16 are pressed against the doll's body. An alternative solution can be provided by having tension cords 17 (indicated by dotted lines) e.g. elastic cords, Velcro cords or cords with tightening buckles, which press the holding plates 15,16 onto the doll's body. Eyelets 53, 53' on the ends of the holding plates 15,16 are provided for attaching these tension cords.

Figure 8:
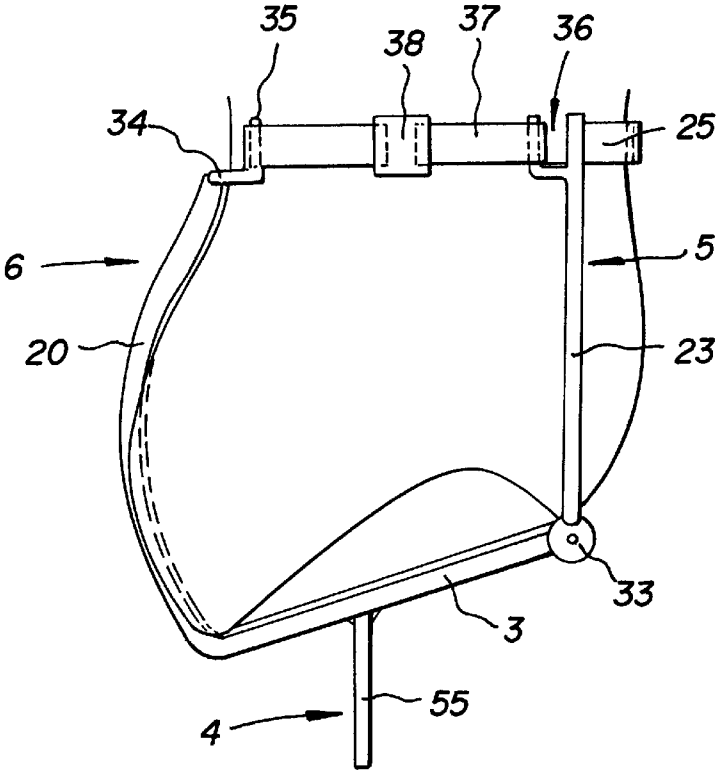
FIG. 8 is a similar view of another embodiment.
Figure 7:
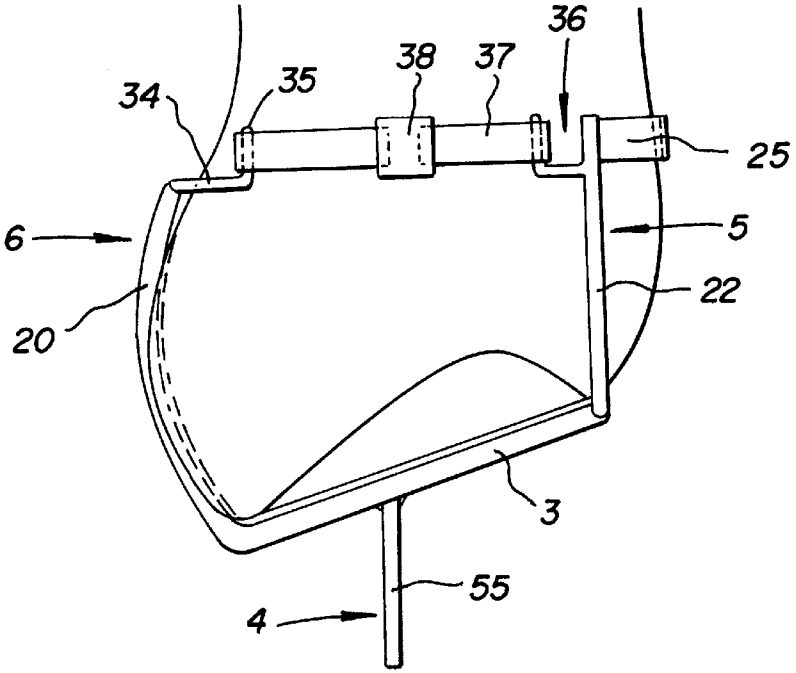
FIG. 7 is a side elevational view of a further embodiment thereof.

Both embodiments of the invention depicted in FIGS. 7 and 8 on the schematically portrayed body of a doll have in common that this variant has a single bracket 20 at the rear in the area of the cleft of the buttocks and two separate brackets 22 and 23 located to the left and right of the curve of the doll's stomach. The brackets 22 and 23 are connected to each other by means of a belt 25. The rear bracket is fitted with a cross-wise bracket 34 which extends horizontally to both sides of the rear bracket 20 and has ends 35 which project up vertically. A belt 37 with a tightening buckle 38 can be attached to these ends 35 and to the fork-shaped holding part 36 on the front brackets 22 and 23. This allows the holding parts 5 and 6 to be buckled to both sides of the doll's body.

In FIG. 8 the two brackets 23 on the right and left hand sides of the stomach are attached to the carrying part 3 by means of a hinge 33. When placing the doll on the carrying part 3 the pair of brackets 23 is lowered forward, the doll is placed in the holding part, the pair of brackets is put back into position and attached with the belts 37 and the tightening buckles 38. Once the doll has been prepared like this, it can be put back onto the support part 2.

The brackets 20,22 depicted in FIG. 7 must be elastic enough to allow the doll to be placed in them. Subsequently, the elastic brackets 20, 22 can be adjusted to the doll's lower body and attached with the belt 37 and the tightening buckles 38.

Figure 9:
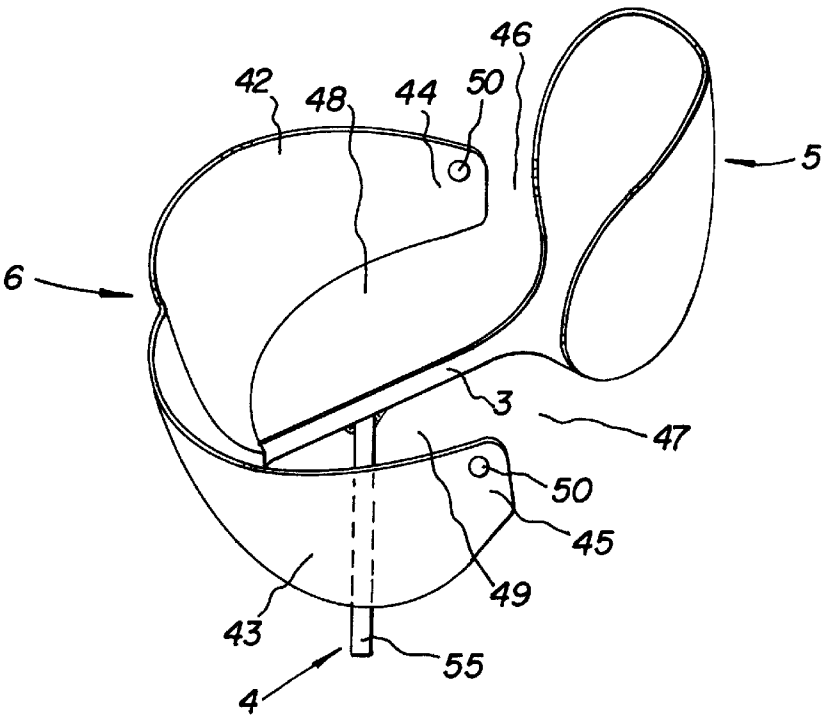
FIG. 9 is a perspective view of a holding part in the form of a seat bowl.
Figure 10:
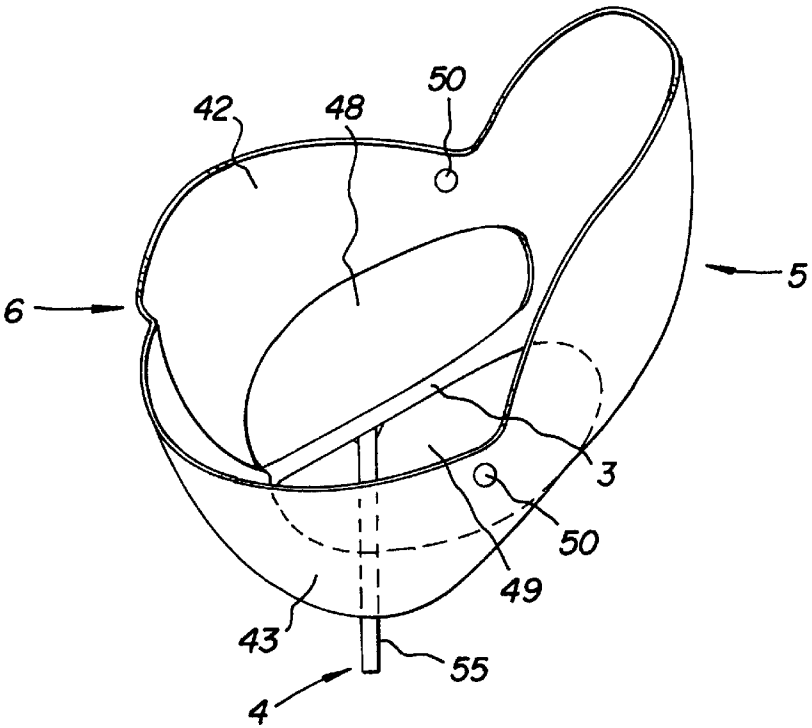
FIG. 10 is a similar view of another seat bowl embodiment.

FIGS. 9 and 10 show versions of the invention in which the holding parts 5,6 are designed as a so-called "seat bowl". FIG. 9 shows a two-part seat bowl, while FIG. 10 shows a single-piece seat-bowl.

The seat bowl in FIG. 9 consists of a stomach part 5 and a posterior part 6 which are attached to each other by the carrying part 3. The posterior part has two lobes 42,43 which encompass the doll's rear. There are two slits 46,47 between the stomach part 5 and the ends 44, 45 of both lobes 42,43 where these extend towards the stomach part 5. These slits 46,47 grow wider into openings 48,49 between the lower edges of the lobes 42, 43 and the carrying part 3. By bending the lobes 42, 43 as well as if necessary, the carrying part 3, the seat bowl depicted in FIG. 9 can be more exactly adjusted to the doll's lower body.

FIG. 10 shows a variant of the seat bowl in which there are no slits 46, 47 and the seat bowl extends completely around the lower body of the doll. The openings 48, 49 must merely be large enough to allow the doll's legs to be put through them and have no other function otherwise.

The embodiments of the invention shown in both FIGS. 9 and 10 allow for a non-slip band, for instance a rubber cord to be affixed to the inner side of the stomach part 5 and the posterior part 6, so that the body of the doll does not slip in the seat bowl. Furthermore, the variants of the stand shown in both FIGS. 9 and 10 are fitted with eyelets 50, to which belts or straps can be attached, which are in turn connected to a belt above the curve of the doll's stomach. This not only allows the doll to be held firmly in the stand, but also provides a measure of theft protection if the doll stand itself is mounted in theft-proof manner in a display room.

The seat bowl, regardless of whether it consists of one part or two, has thin walls and is adapted to the form of the lower body. If the seat bowl is to be made of metal or plastic, molds are required. However, these additional costs can be justified for "artistic" dolls which are usually produced in limited editions of 600 to 1,000. If the next "artists" doll has the same lower body form, the costs for additional stands fall. This is even truer for the production of new dolls manufactured in large numbers. If an elegant seat bowl is required for a particularly valuable doll, such a bowl can be individually modeled. If the seat bowl is fitted with a coupling part 4 it is also better if the seat bowl is fitted to the doll first and then placed upon the support part 2 together with doll to prevent support part 2 from being bent.

The holding part 5,6 with tension straps is the correct solution for the presentation of antique dolls in museums and collections where almost every doll is unique.

The holding part 5,6 with brackets is the correct solution for dealers who have to be able to free the lower body of the doll quickly during a sale.

It is easy to change the method of attachment of the lower end of the support part from one of the possible methods (e.g. in the display plate) to an alternative method (under the display plate, with rotating mechanism, without rotating mechanism, with base plate) by changing support part 2.

If turntable rotating units are used, the doll will probably be revolved once in half a minute to one minute. The connection between the rotating mechanism and support part 2, (and if the connection with support part 2 is made of several parts), the connections between the individual elements and the connection between the support part 2 and the coupling part 4 should be stable enough to transfer jolting torque and thrusts.

The doll stand described in this specification is no longer of the familiar off the shelf type which is purchased in completely assembled form, and the doll is mounted on the assembly. In order to display dolls with this new form of stand, the user selects the appropriate pre-finished parts such as carrying part 3 with coupling part 4 and holding parts 5,6, the correct form and model of support part 2, the correct form and method of attachment of the lower end of the support part and the necessary material and extra parts. This will all have to be produced.

Furthermore, if the stand is intended for an antique doll, carrying part 3 with its coupling part 4 and the tension straps 5,6 have to be bandaged to the doll's lower body. Devices will surely be offered to help in this process. Nevertheless, the user (the museum owner, collector or dealer) will require technical skills in order to carry out the fitting themselves. Otherwise the services of a professional will be required. This will lead to the creation of jobs in both the production and service sectors.

Those skilled in this art will appreciate that each doll requires its own doll stand which will not fit another doll, even if the doll is the same size. The reason for this is the difference in lower body forms of dolls produced by different manufacturers. However, the producer is starting from the assumption that worldwide there are thousands of museums and probably hundreds of thousands of collectors who own the same type of dolls.

There is a great deal of literature about antique dolls which serve as a reference point for dolls' lower body forms. A special comparative survey of the dolls' bodies used by the diverse manufacturers is unknown in specialist circles. Companies still produce dolls bodies using old forms, as they are needed for reproduction dolls. If this information were collected, evaluated according to specific criteria, selection lists and cut-outs to try on doll's bodies would be a first orientation aid for the producer.

The same applies for carrying parts with holding parts 5 and 6 in the form of brackets.

When ordering a seat bowl, e.g. for an "artistic" doll, the user would make the doll available for measuring purposes as a form is produced on the basis of the measurements. The alternative option would be for the producer to manufacture the seat bowl in functional sizes and subsequently recommend the resulting lower body form to the manufacturers of "artistic" dolls. In the final analysis, this would lower the costs for the seat bowl for the manufacturers of "artistic" dolls.

Furthermore, the market sector of new dolls currently being produced should also be taken into account. These dolls could also be sold together with seat bowls.

For these new dolls, as well as artistic and reproduction dolls, only the seat bowl could be provided as a fixed component of the doll. Support part 2 and everything connected to it (base part, no base plate, rotating mechanism etc.) can be selected by the purchaser of the doll.

I claim:

1. A doll stand for supporting and holding a doll in an upright position, wherein the doll has a torso with a lower body having an abdomen side and a rear side with buttocks and legs attached to the torso, the doll stand comprising:

a base;

a vertical support part mounted on said base and held in substantially vertical orientation, said support part being adapted to extend vertically between and substantially parallel to the legs of the upright doll to the lower body of the doll;

a carrying part having two free ends and a substantially horizontal middle section, said middle section being adapted to support a weight of the doll on said vertical support part and to be positioned at the lower body thereof between the legs of the doll and extending from the abdomen side of the lower torso to the buttocks thereof;

a coupling part attached substantially centrally to said middle section and projecting downwardly from said middle section for attachment to said vertical support part; and two holding parts connected to said free ends, said middle section together with said two holding parts substantially forming a U with one holding part adapted to extend upwardly on the abdomen side and one holding part adapted to extend upwardly on the rear side of the doll.

2. The doll stand according to claim 1, wherein said coupling part and said vertical support part together form a plug and socket connection.

3. The doll stand according to claim 2, wherein said coupling part is a hinge consisting of a fork-shaped carrier connected with a pin, and a disk on said carrying part connected to the carrier by a joint bolt, whereby said pin is screwed into said carrier for forming a locking connection for adjusting an angle between said carrying part and said pin.

4. The doll stand according to claim 1, wherein said vertical support part is formed from elongated components selected from the group consisting of rods sections and tube sections.

5. The doll stand according to claim 1, wherein said vertical support part has a bottom end for connection with said base.

6. The doll stand according to claim 5, wherein said base is a presentation plate and the bottom end of said support part is fastened directly into said presentation plate.

7. The doll stand according to claim 5, wherein a bottom end of said support part is permanently or detachably mounted approximately in the center of said base.

8. The doll stand according to claim 1, wherein said holding parts include tensions straps adapted to extend upwardly on the abdomen side and rear side and which are adapted to be bandaged to the body of the doll.

9. The doll stand according to claim 8, wherein said tension straps are formed with crosswise struts.

10. The doll stand according to claim 8, wherein said holding parts and said carrying part are integrally formed into a single element with a substantially even width adapted to extend between the legs of the doll.

11. The doll stand according to claim 8, which further comprises an adhesive band affixed to said tension straps with a non-adhesive side thereof adapted to face towards the body of the doll and extending a short distance beyond the length-wise sides of said tension straps.

12. The doll stand according to claim 1, wherein said holding parts and said carrying part form a seat bowl.

13. The doll stand according to claim 12, wherein said seat bowl includes a stomach part formed by said abdomen side holding part, a posterior part formed by said rear side holding part, said middle section and interconnecting both parts of said seat bowl.

14. The doll stand according to claim 13, wherein said seat bowl is formed with completely closed walls without slits formed therein.

15. The doll stand according to claim 13, which further comprises a non-slip band disposed on an upper edge of said seat bowl inside said stomach part and said posterior part.

16. The doll stand according to claim 12, wherein said seat bowl is formed with eyelets, and including a belt drawn through said eyelets and adapted to be fitted above a curve of the abdomen of the doll.

17. The doll stand according to claim 1, wherein said abdomen side holding part is formed as brackets adapted to extend upwardly on the abdomen side of the doll and said rear side holding part is formed as a bracket adapted to extend upwardly on the rear side of the doll.

18. The doll stand according to claim 17, which comprises straps connecting free ends of said brackets to one another.

19. The doll stand according to claim 17, wherein said brackets are elastic.

20. The doll stand according to claim 17, which comprises a hinge pivotally connecting said abdomen side brackets to said middle section.

21. The doll stand according to claim 1, wherein said front side holding part is formed with two mutually spaced apart brackets extending upwardly and said rear side holding part is formed with one bracket extending upwardly.

22. The doll stand according to claim 1, wherein a height of the doll stand is adjustable.

* * * * *